US010233891B1

(12) United States Patent
Rezaei et al.

(10) Patent No.: US 10,233,891 B1
(45) Date of Patent: Mar. 19, 2019

(54) CONTROLLER FOR SPARK PLUG OF ENGINE

(71) Applicant: Caterpillar Inc., Peoria, IL (US)

(72) Inventors: Morteza Rezaei, Chino, CA (US); Bahman Gozloo, Peoria, IL (US); William Eugene Hoban, Jr., Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/790,152

(22) Filed: Oct. 23, 2017

(51) Int. Cl.
*F02P 19/00* (2006.01)
*F02P 9/00* (2006.01)
*F02P 17/10* (2006.01)

(52) U.S. Cl.
CPC ..... *F02P 9/002* (2013.01); *F02P 17/10* (2013.01)

(58) Field of Classification Search
CPC ..... F02P 3/05; F02P 9/00; F02P 9/002; F02P 15/00; F02P 17/10; F02P 17/12
USPC ..... 123/143 B, 143 R, 609, 618, 620, 630, 123/642, 643
See application file for complete search history.

(56) References Cited

U.S. PATENT DOCUMENTS 5,692,484 A * 12/1997 Downey ..... F02P 7/077 123/643
5,715,801 A * 2/1998 Murasawa ..... F02P 3/02 123/642
5,933,009 A * 8/1999 Kayser ..... F02P 17/12 324/379
6,131,555 A 10/2000 Tozzi et al.
6,357,428 B1 * 3/2002 Baumberger ..... F02P 17/12 123/644
6,629,520 B2 10/2003 Inagaki et al.
6,758,199 B2 7/2004 Masters et al.
7,789,595 B2 9/2010 Tanaya
8,485,166 B2 * 7/2013 Aida ..... F02P 3/09 123/597
9,702,332 B2 * 7/2017 Shibata ..... F02P 9/002
2010/0206277 A1 * 8/2010 Kajita ..... F02P 3/0846 123/620
2013/0076362 A1 * 3/2013 Steinrueck ..... F02P 17/12 324/382
2015/0300271 A1 * 10/2015 Inada ..... F02D 17/02 123/406.12
2016/0115880 A1 4/2016 Kondo et al.
2016/0138552 A1 * 5/2016 Itoi ..... F02P 9/002 315/127

* cited by examiner

*Primary Examiner* — Hung Q Nguyen
*Assistant Examiner* — Johnny H Hoang
(74) *Attorney, Agent, or Firm* — Mattingly Burke Cohen & Biederman

(57) ABSTRACT

A controller for a spark plug of an engine is provided. The controller is configured to receive a signal indicative of an operational parameter of the engine. The controller is configured to define a breakdown time duration for the spark plug. Further, the controller is configured to determine an optimum amount of energy required to generate a spark for the spark plug based on the defined breakdown time duration and the operational parameter. The controller is further configured to cause the optimum amount of energy to be supplied to the spark plug to cause the spark to be generated for the spark plug.

20 Claims, 6 Drawing Sheets

CONTROLLER FOR SPARK PLUG OF ENGINE

TECHNICAL FIELD

The present disclosure relates to spark plugs used in ignition systems of engines. More particularly, the present disclosure relates to system and method for reducing wear and thereby enhancing life of a spark plug.

BACKGROUND

Generally, engines such as gasoline engines, gaseous-fuel engines, and dual-fuel engines, include an ignition system for igniting an air-fuel mixture to produce heat, which may be used to produce mechanical power. Some ignition systems may include a spark plug which may produce a spark to initiate combustion of the air-fuel mixture. Ignition systems typically include a primary coil and a secondary coil coupled to the primary coil. The spark plug is connected across the secondary coil, and a current through the primary coil induces a high voltage across the secondary coil that establishes an are across a spark gap of the spark plug.

In some engines, a monitoring system measures various parameters of the ignition system as the engine operates. An electronic control unit (ECU) (or controller) and/or a machine operator may use information output by the monitoring system to monitor and thereby control engine (more particularly spark plug) operation and/or to determine when sparking is required (e.g., a spark plug cycle needs to be controlled). In some controller systems, an ECU may rely on a fixed primary current and a boost voltage and like parameters to control working of the spark plug, by effectuating change in breakdown time duration. This strategy may have shortcomings such as delivering more than required energy for the spark plug and thereby leading to damage of the spark plug.

U.S. Pat. No. 6,758,199 discloses an ignition system. The ignition system employs a piezoelectric transformer having a drive side and an output side, wherein the output side is in electronic communication with circuit elements that tune output impedance in series with a breakdown gap to optimize power flow from the transformer to the breakdown gap after breakdown. Further, the ignition system includes a timing control circuit in electronic communication with the drive side that meters post-breakdown energy delivered to the breakdown gap by timing the duration of post-breakdown power flow.

SUMMARY

In an aspect of the present disclosure, a controller for a spark plug of an engine is provided. The controller is configured to receive a signal indicative of an operational parameter of the engine. The controller is configured to define a breakdown time duration for the spark plug. Further, the controller is configured to determine an optimum amount of energy required to generate a spark for the spark plug based on the defined breakdown time duration and the operational parameter. Further, the controller is configured to cause the optimum amount of energy to be supplied to the spark plug to cause the spark to be generated for the spark plug.

In another aspect of the present disclosure, a method of controlling a spark plug of an engine is provided. The method includes receiving an operational parameter of the engine by the controller. The method includes defining a breakdown time duration for the spark plug by the controller. The method further includes determining an optimum amount of energy required to generate a spark for the spark plug by the controller based on the defined breakdown time duration and the operational parameter. The method further includes causing the optimum amount of energy to be supplied to the spark plug by the controller to cause the spark to be generated for the spark plug.

In yet another aspect of the present disclosure, a machine is provided. The machine comprises an engine having a combustion chamber. The machine comprises a spark plug configured to ignite a fuel mixture by generating a spark within the combustion chamber. The machine comprises an operational parameter sensor configured to generate a signal indicative of an operational parameter of the engine. The machine further comprises a controller communicably coupled to the engine, the spark plug, and the operational parameter sensor. The controller is configured to define a breakdown time duration for the spark plug. Further, the controller is configured to determine an optimum amount of energy required to generate the spark for the spark plug based on the defined breakdown time duration, and the operational parameter. Further, the controller is configured to cause the optimum amount of energy to be supplied to the spark plug to cause the spark to be generated for the spark plug.

DETAILED DESCRIPTION

Figure 1:
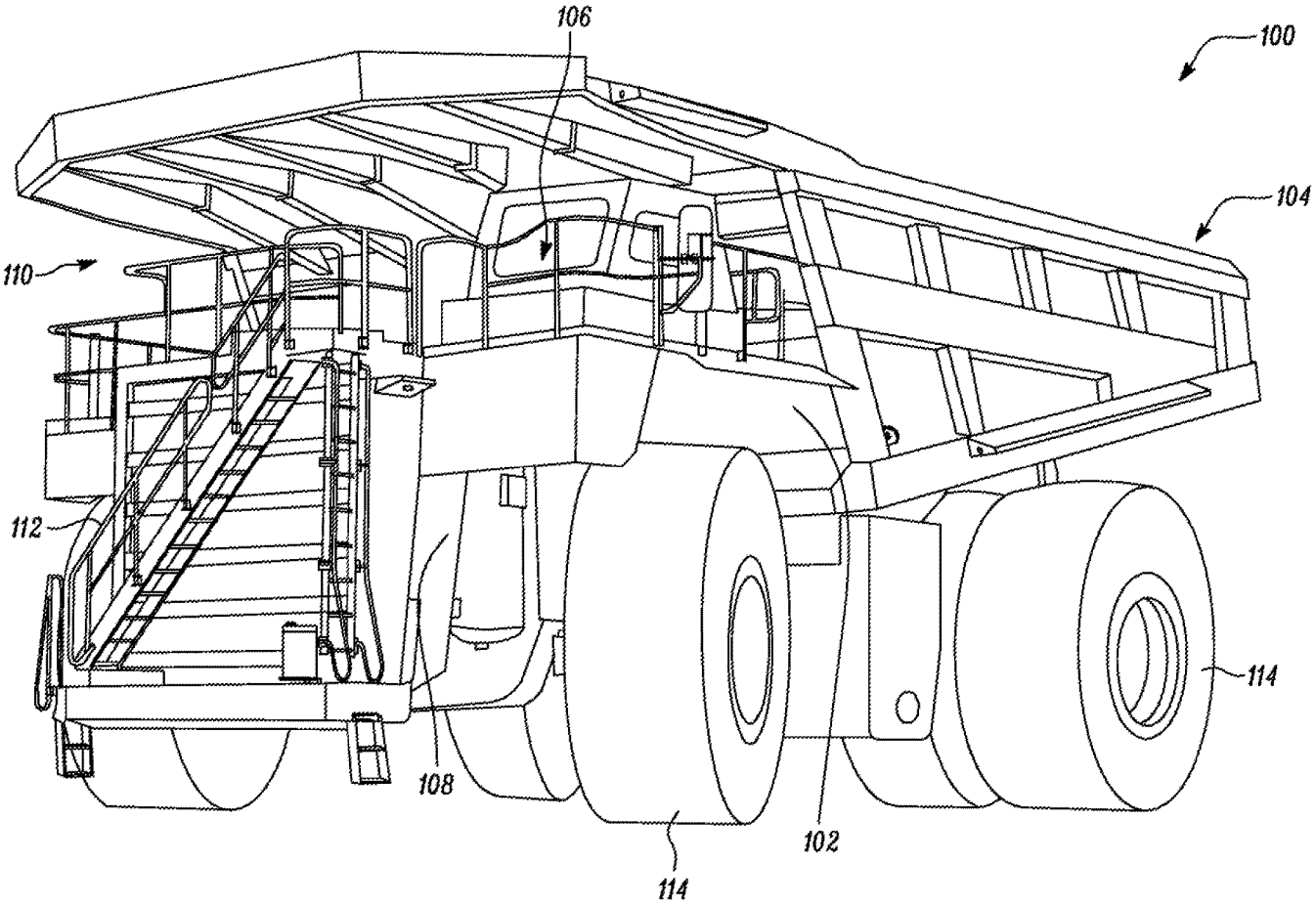
FIG. 1 illustrates a perspective view of an exemplary machine, according to some embodiments of the present disclosure.

Wherever possible, the same reference numbers will be used throughout the drawings to refer to same or the like parts. FIG. 1 illustrates an exemplary machine 100, according to one embodiment of the present disclosure. More specifically, as shown in the accompanied figures, the machine 100 may include a large mining truck. It should be understood that the machine 100 may alternatively include any other suitable construction machine to which various aspects of the present disclosure may apply. Further, the present disclosure may also apply to non-machine applications such as, but not limited to, engines used for power generators, marine vessels, and/or the like.

Referring to FIG. 1, the machine 100 includes a frame 102. A payload carrier 104 is pivotally mounted to the frame 102. Further, an operator cab 106 is mounted to the frame 102, such as above an engine enclosure 108 and on a front side 110 of the frame 102. The operator cab 106 may include various control systems and components required to operate the machine 100 in a desired manner. The machine 100 includes a staircase 112 on the front side 110 of the frame 102 to allow an operator to climb up to the operator cab 106. The machine 100 may be supported, on a ground surface, by a plurality of wheels 114.

The machine 100 may include various other systems and components which may be used to operate the machine 100 such as a suspension system, a drivetrain, an air conditioning system, etc. (not shown). However, such systems are not described here as the present disclosure is not limited by any such system or component in any manner. Further, a person of ordinary skill in the art will appreciate that one or more power sources (not shown) may be housed within the engine enclosure 108. The one or more power sources may provide power to the plurality of wheels 114 and a final drive assembly, via a mechanical or electric drive train. In some embodiment, the one or more power sources may include an internal combustion engine 200 (shown in FIG. 2).

Figure 2:
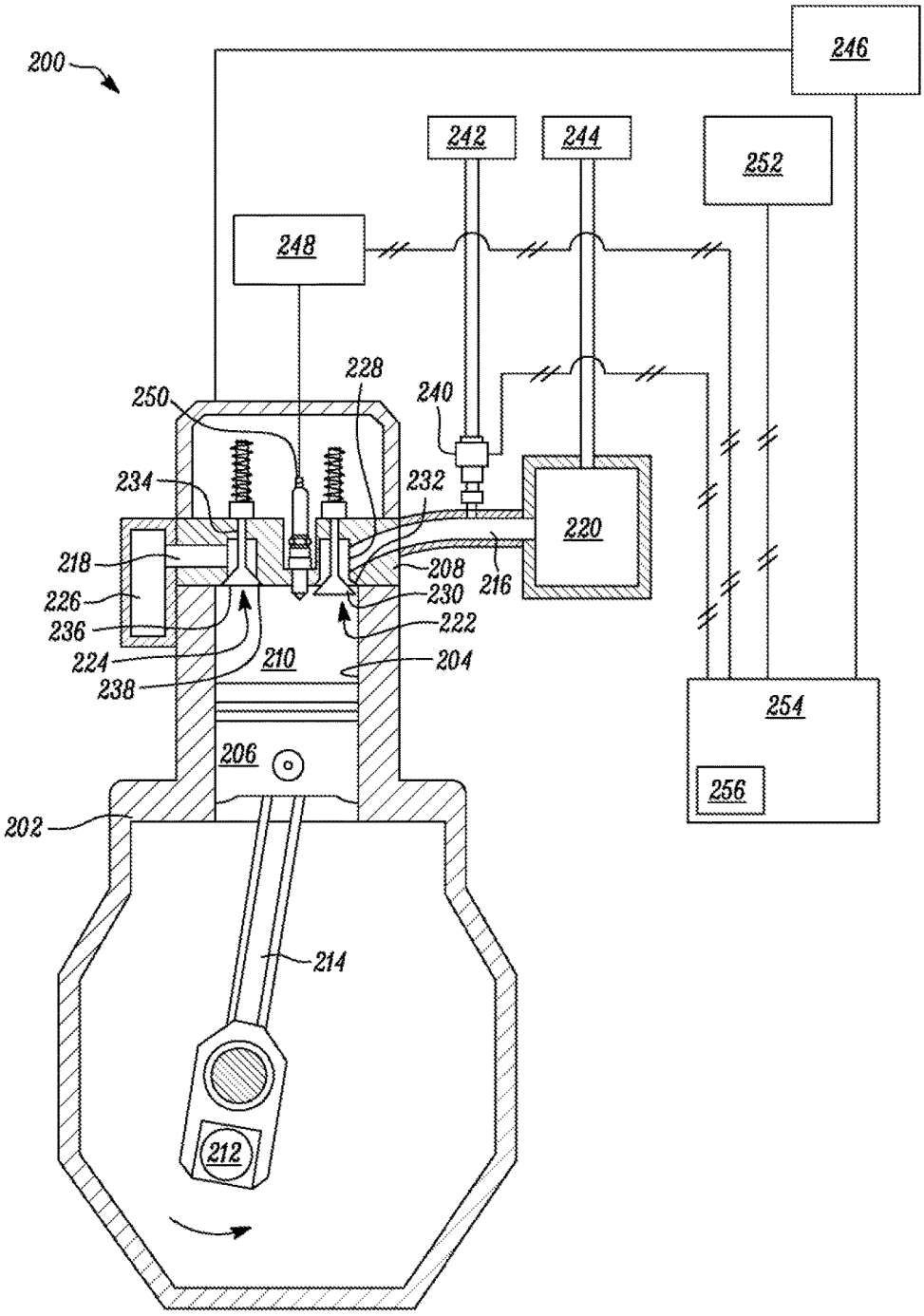
FIG. 2 schematically illustrates an exemplary engine, according to some embodiments of the present disclosure.

FIG. 2 illustrates the internal combustion engine 200 (hereinafter referred to as the engine 200). For the purposes of this disclosure, the engine 200 will be described as a four-stroke gaseous-fueled engine, for example a natural gas engine. One skilled in the art will recognize, however, that the engine 200 may be any other type of combustion engine such as, for example, a gasoline or a dual-fuel engine.

The engine 200 includes an engine block 202 that at least partially defines one or more cylinders 204 (only one shown in FIG. 2). A piston 206 may slide within each cylinder 204 to reciprocate between a top-dead-center (TDC) position and a bottom-dead-center (BDC) position, and a cylinder head 208 is associated with each cylinder 204. The cylinder 204, the piston 206, and the cylinder head 208 together define a combustion chamber 210. It is contemplated that the engine 200 includes any number of combustion chambers and that combustion chambers may be disposed in an "in-line" configuration, a "V" configuration, or in any other suitable configuration.

An ignition system 254 is associated with the engine 200 to help regulate the combustion of the fuel mixture within the combustion chamber 210 during a series of ignition sequences. In an exemplary embodiment, the ignition system 254 may be a capacitive discharge ignition system, although other systems are possible. The ignition system 254 includes an ignition coil 248, a spark plug 250, one or more auxiliary injectors (not shown), a power source 252, and a controller 256.

The ignition coil 248 may be operatively connected, electrically coupled, in communication, and/or otherwise associated with the controller 256, the spark plug 250, and/or the power source 252. In some embodiments, the ignition coil 248 may be a separate component of the ignition system 254. Additionally, or alternatively, the ignition coil 248 may be a component of the spark plug 250 or other electrical devices included in the ignition system 254. The ignition coil 248 may comprise an inductor, a capacitor, and/or other like electrical devices configured to store electrical energy until such energy is controllably released. In some embodiments, the ignition coil 248 includes a primary coil 306 (shown in FIG. 3) and a secondary coil 318 (shown in FIG. 3) such that the primary coil 306 is electrically coupled to the controller 256 and the secondary coil 318 is electrically coupled to the spark plug 250.

The power source 252 is operably connected to the controller 256 and configured to supply energy to one or more components of the ignition system 254 and/or other engine components discussed herein. In some embodiments, the power source 252 may be provided inside the ignition system 254. The power source 252 may be a constant voltage, direct current source such as a battery or other similar device. The power source 252 may be configured to direct any desired voltage to the components of the ignition system 254 to facilitate operation thereof, and such voltage may be increased and/or decreased by one or more converters, stepper circuits, amplification circuits, and/or other like electrical components. In some embodiments, the voltage supplied by the power source 252 may be controlled by the controller 256.

The controller 256 may include a single or multiple microprocessor, field programmable gate arrays (FPGAs), digital signal processors (DSPs), etc., that may control an operation of the engine 200 and/or individual engine components. For example, the controller 256 may be configured to control the ignition system 254 and/or the power source 252, based upon a control program (or one or more instructions) stored in a memory associated with the controller 256.

The engine 200 further includes an operational parameter sensor 246. The operational parameter sensor 246 may generate a signal indicative of an operational parameter of the engine 200. In the context of the present disclosure, the operational parameter may be a parameter indicative of current operating conditions of the engine 200. When the engine 200 initially starts operation, the controller 256 may be calibrated to control the engine 200 based on the operational parameters of the engine 200 at the initial time. However, as the values of the operational parameters change over time, the change should be taken into consideration in order to operate the engine 200 efficiently. The present disclosure accounts for this change through the operational parameter sensor 246 providing updated values of the operational parameters.

The operational parameter may be one or more of a spark plug age, an engine cylinder pressure, an engine cylinder temperature, or an ambient humidity of the engine 200, and/or the like. The spark plug age may refer to a period of time that has elapsed since the spark plug 250 started operation with the engine 200. Additionally, or alternatively, the spark plug age may refer to a remaining age of the spark plug 250. Additionally, or alternatively, the spark plug age is indicative of an amount of wear of the spark plug 250. The engine cylinder pressure may refer to pressure of the cylinder 204 of the engine 200. The engine cylinder temperature may refer to a temperature of the cylinder 204 of the engine 200. Appropriate sensors may be provided to measure the operational parameter as needed. For example, an in-cylinder pressure sensor may be provided to measure the engine cylinder pressure.

Figure 3:
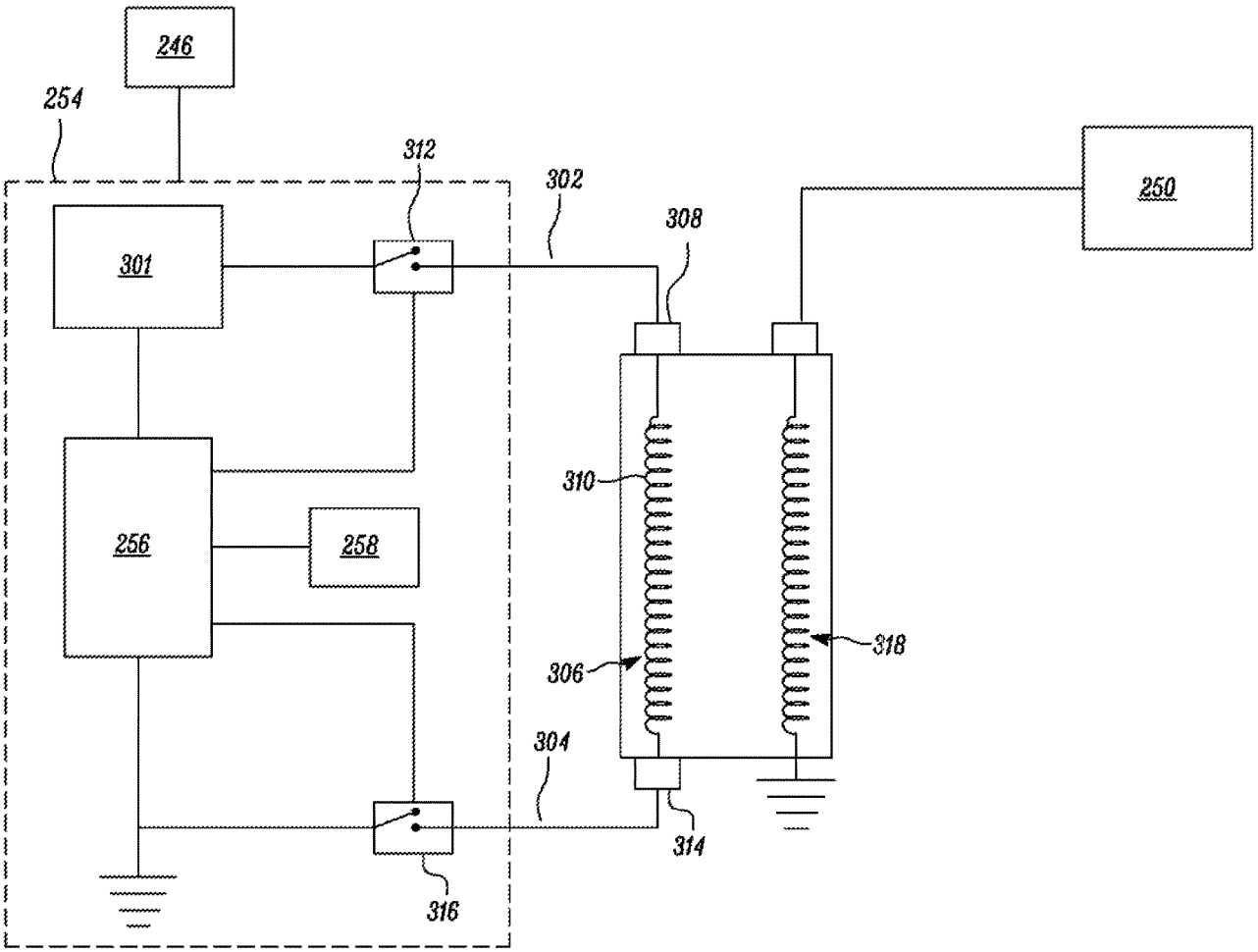
FIG. 3 is a schematic illustration of an exemplary ignition system, according to some embodiments of the present disclosure.

FIG. 3 illustrates the ignition system 254 which includes the various components in accordance with some embodiments of the present disclosure. The ignition system 254 includes a power supply 301 to supply primary voltage to the ignition coil 248. The power supply 301 may include, or may be connected to a converter (not shown) configured to convert the electricity into a form suitable for application with the ignition coil 248 (shown in FIG. 2). In some embodiments, output of the power supply 301 may be controlled by the controller 256. Additionally, or alternatively, the power supply 301 may not be a part of the ignition system 254 and can be located outside the ignition system 254.

The ignition coil 248 includes a high side 302 and a low side 304. The high side 302 leads to a primary coil 306 of the ignition coil 248, such as through a high side pin 308.

The primary coil 306 includes primary windings 310 connected between the high side 302 and the low side 304. The high side 302 also includes a high side switch 312 (also referred to as high side driver 312) connected between the power supply 301 and the ignition coil 248. The high side driver 312, which is controlled by the controller 256, may be an ignition switch configured to open and close to selectively complete a circuit between the power supply 301 and the ignition coil 248. In addition, during an ignition cycle, the high side switch 312 may open and close to modulate current in the ignition coil 248 between an upper threshold and a lower threshold.

As shown in FIG. 3, the primary coil 306 leads to the low side 304 of the ignition coil 248, such as through a low side pin 314. The low side 304 includes a low side switch 316 (also referred to as low side driver 316) and the controller 256. The low side driver 316, which is controlled by the controller 256, may be a switch configured to open and close to selectively allow current to flow through the primary coil 306 and, thereby, to build a voltage across a secondary coil 318 in accordance with a fixed breakdown time duration. The secondary coil 318 directs the high voltage to the spark plug 250 for generation of a spark. The controller 256 may be configured to determine the breakdown time duration and/or an optimum amount of energy for a spark of the spark plug 250. The optimum amount of energy is a minimum possible amount of energy which should be supplied to the spark plug 250 to generate a spark successfully inside the combustion chamber 204. In some embodiments, the optimum amount of energy may be less than the high amount of energy typically provided to generate the spark. The spark plug 250 may also generate the spark by receiving supply of energy higher than the optimum amount of energy, however in such a scenario at least some amount of energy is wasted.

The breakdown time duration (also known as spark time), as used in context of the present disclosure, shall refer to a fixed time for which the optimum amount of energy supplied to the spark plug 250 would be sufficient enough to generate a spark for the spark plug 250. In the context of the present disclosure, supplying the optimum amount of energy to the spark plug 250 refers to supplying primary current and boost voltage to the primary coil 306. The primary current and the boost voltage are supplied corresponding to the optimum amount of energy. Boost voltage refers to a voltage supplied to the primary coil 306 for generating the spark in the spark plug 250. Generating the spark by providing only the optimum amount of energy protects the spark plug 250 from any undesirable damage, to the spark plug 250, from unusually high magnitude of energy (or amount of energy exceeding a threshold) as produced in case of conventional ignition systems and engines associated therewith.

In some embodiments, the controller 256, at first, supplies fixed primary current, and fixed boost voltage to the primary coil 306. Then, the controller 256 measures the breakdown time duration. For example, the controller 256 may include a spark detection circuit 258 which may detect a preliminary spark generated for the spark plug 250 by supplying the fixed primary current and fixed boost voltage to the primary coil 306. The controller 256 may then determine the breakdown time duration by comparing the time instance of the preliminary spark being detected, and the time instance of start of supply of the fixed primary current and the fixed boost voltage.

The controller 256 then calculates breakdown voltage based on the calculated breakdown time duration. As the total energy supplied to the primary coil 306 for generating the preliminary spark, and the breakdown time duration is known, the controller 256 may calculate the breakdown voltage accordingly. Electrical energy supplied to the primary coil 306 is directly proportional to the current and the voltage. In some embodiments, the electrical energy supplied to the primary coil 306 may be defined as a product of the current supplied, the voltage across the primary coil 306, and breakdown time period. In the context of the present disclosure, as the amount of energy supplied is known, the breakdown time duration is measured, and the primary current remains the same, the corresponding breakdown voltage may be determined.

In some embodiments, the controller 256 may include information to determine the breakdown voltage. For example, the controller may include information identifying an equation regarding the breakdown time duration and the optimum amount of energy as described below:

$$t = \frac{-L_1}{R_1} \cdot \ln\left(1 - \frac{U_{Breakdown}}{U_{Boost}} \cdot \sqrt{\frac{C_1\left(\frac{N_1}{N_2}\right) + C_2}{L_1}} \cdot R_1\right)$$

wherein, t is the measured breakdown time duration.

$C_1$ is a capacitor coupled with the controller 256. The capacitor C1 may also be provided inside the controller 256.

$R_1$ and $L_1$ are resistance and inductance respectively of the primary coil 306.

$R_2$, $L_2$, and $C_2$ are resistance, inductance, and capacitance of the secondary coil 318.

$C_1$, $C_2$, $L_1$, $R_1$, $N_1$, $N_2$ may all depend upon the type of the ignition system being used. The type of ignition may refer to a manner in which the preliminary spark is generated by the ignition system such as contact type ignition, transistor type ignition, electronic type ignition, and/or the like. The contact type ignition uses mechanical contacts known as breaker points to cut off primary current that is used to generate the spark. The transistor type ignition uses a transistor to cut off the primary current that is used to generate the spark. The electronic type ignition typically uses a microcontroller to cut off primary current that is used to generate the spark. The present disclosure is not limited by variables of the equation and/or the type of the ignition system in any manner.

Further, the controller 256 may be configured to solve the equation for the boost voltage (represented by $U_{Boost}$) based on the defined breakdown time duration and the breakdown voltage. Then, the calculated value of the boost voltage may be used for next ignition firing with the same value of the primary current as used in last ignition cycle. As used herein, "ignition cycle" may be used to refer to a series of events starting from supplying energy to the primary coil 306 of the spark plug 250 to the ignition of fuel inside the combustion chamber 204. It should be contemplated that the series of the steps elaborated herein are for exemplary purpose only, and some of the steps may be performed in parallel and/or in an order different than the order above.

In some embodiments, the controller 256 for the spark plug 250 of the engine 200 may be communicably coupled to the operational parameter sensor 246. The controller 256 may receive the signal indicative of an operational parameter of the engine 200 generated by the operational parameter sensor 246. The operational parameter of the engine 200 may include one or more of a spark plug age, an engine cylinder pressure, an engine cylinder temperature, and/or an ambient humidity of the engine 200.

The controller 256 may be configured to determine the optimum amount of energy required to generate the spark for the spark plug 250 based on the defined breakdown time duration and the operational parameter. Further, the controller 256 may be configured to supply the optimum amount of energy to the spark plug 250 to generate a spark for the spark plug 250.

The controller 256 may determine an optimum boost voltage corresponding to the optimum amount of energy required. As the primary current is kept fixed, and the optimum amount of energy supplied to the spark plug 250 is known, the controller 256 may calculate the optimum boost voltage accordingly. Electrical energy supplied to the primary coil 306 is directly proportional to the current and the voltage. In some embodiments, the electrical energy supplied to the primary coil 306 may be defined as a product of the current supplied, the voltage across the primary coil 306, and breakdown time period. In the context of the present disclosure, the primary current is kept fixed, and the optimum amount of energy is known, so the optimum boost voltage can be calculated. The controller 256 may supply the optimum primary current, and the optimum boost voltage to the spark plug 250 to supply the optimum energy to the spark plug 250. In some embodiments, the controller 256 may be configured to determine the optimum amount of energy required based on the defined breakdown time duration, the operational parameter, a gap between electrodes of the spark plug 250, an engine cylinder pressure, and/or an engine cylinder temperature.

In some embodiments, defining the fixed breakdown time duration may include detecting the preliminary spark in the spark plug 250 through the spark detection circuit 258, and determining the breakdown time duration based on detecting of the spark. The controller 256 may further be configured to determine a post breakdown time duration for the spark plug 250 based on the breakdown time duration.

Figure 4:
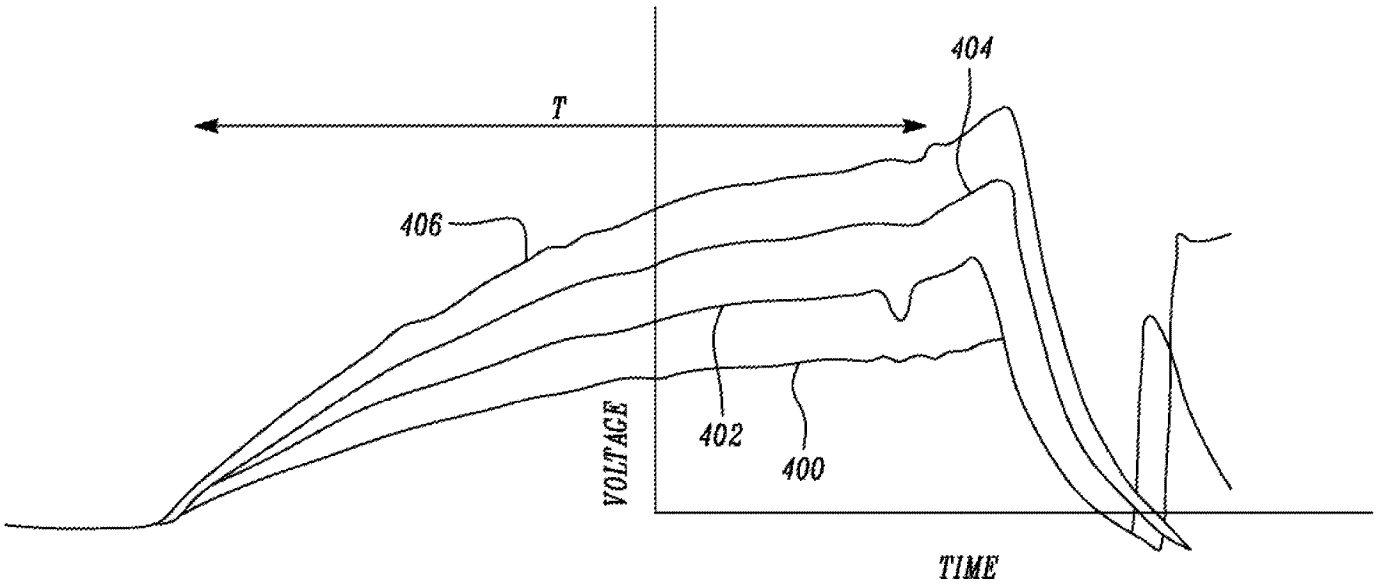
FIG. 4 illustrates exemplary waveforms of current across the secondary coil during an ignition cycle for different operating parameters of the engine, according to some embodiments of the present disclosure.

FIG. 4 illustrates example waveforms 400, 402, 404, and 406 of the current across the secondary coil during an ignition cycle for different operating parameters of the engine 200. As illustrated, although the waveforms 400, 402, 404, and 406 (for different operating conditions) follow the fixed breakdown time duration marked as 'T' in the figure, the optimum amount of energy corresponding to each waveform is expected to vary per operating condition and/or the like. For example, the waveform 400 would be a preferable scenario, in accordance with various aspects of the present disclosure, at least due to optimum amount of energy considerations that is dependent upon one or more operational parameters that are monitored by the operational parameter sensor 246.

In some embodiments, the controller 256 may be configured to define the breakdown time duration and/or the post breakdown time duration based on the spark plug specifications. The spark plug specifications typically include parameters such as gap between electrodes of spark plug 250, material of electrodes, or any other such parameters. The controller 256 may also use operating parameters to define the breakdown time duration and/or the post breakdown time duration. The controller 256 may use one or more algorithms, equations, maps and/or look-up tables that define a relationship between the breakdown time/post breakdown time and the operating parameters among other factors. In certain embodiments, the breakdown time may be used to determine the optimum amount of energy for the spark plug 250.

For example, the controller 256 may compare the breakdown time to a threshold value. Based on the comparison, the controller 256 may determine the optimum amount of energy for the spark plug 250. The spark plug 250 can be controlled easily using the parameters associated with the engine 200, promoting efficient use of the spark plug 250 and reducing maintenance costs.

Figure 5:
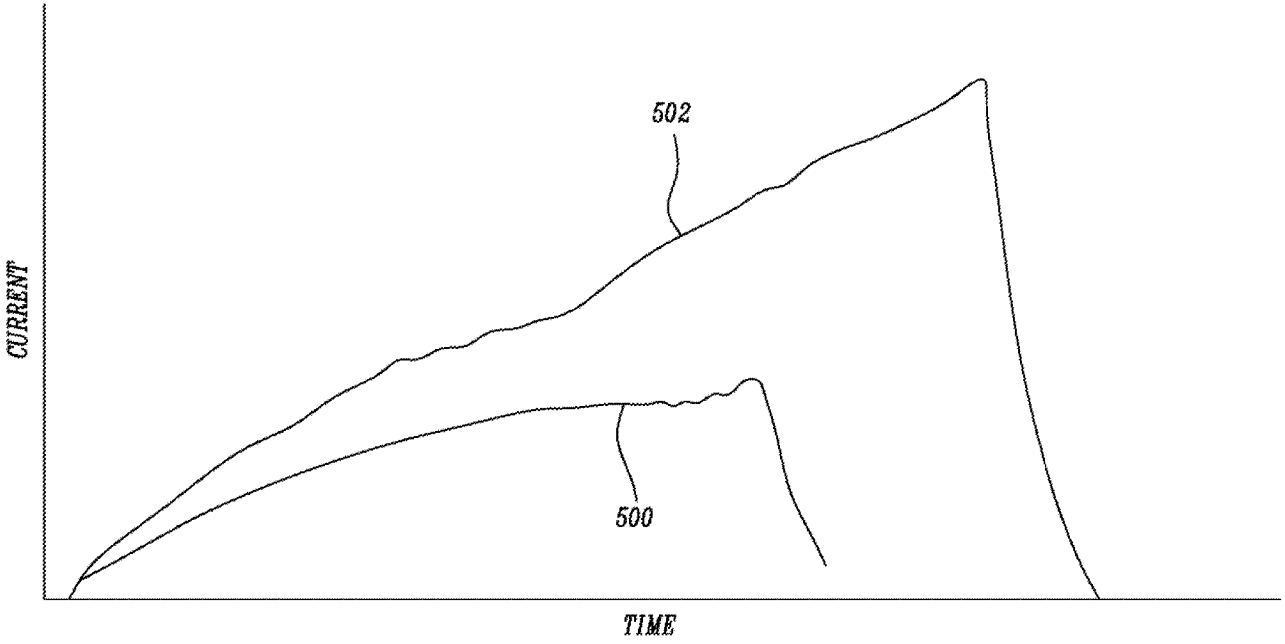
FIG. 5 illustrates exemplary waveforms of energy flowing through the primary coil for different operating conditions, according to some embodiments of the present disclosure.

FIG. 5 illustrates example waveforms 500 and 502 of the energy through the primary coil 306 for different operating durations. The operating duration may be defined as a period of time for which the primary coil 306 is supplied with the primary current. As shown in FIG. 5, the optimum amount of energy (i.e. for waveform 500), in accordance with an implementation of the present disclosure, is substantially lesser than the optimum amount of energy for waveform 502 for conventional spark ignition with the fixed primary current and the boost voltage. Thus, fixing of the breakdown time and/or the post breakdown time, by the controller 256, provides benefits such as optimum amount of energy (e.g., reduced amount of energy) as illustrated through the waveform 500, and thereby enhances life of the spark plug 250.

INDUSTRIAL APPLICABILITY

The present disclosure is related to a method and a system for enhancing life of the spark plug 250. The exemplary disclosed controller 256 may be applicable to any ignition system that includes a spark igniter, providing a more robust and consistent system for measuring one or more parameters associated with the spark plug 250 and/or ignition coil 248 (e.g., generation of the spark during the ignition cycle). In some embodiments, the controller 256, is configured to define the breakdown time for the spark plug 250. Additionally, or alternatively, the controller 256 is configured to determine the optimum amount of energy (generally minimum possible amount of energy for the case) required to generate the spark for the spark plug 250 in accordance with factors and/or parameters described herein.

Figure 6:
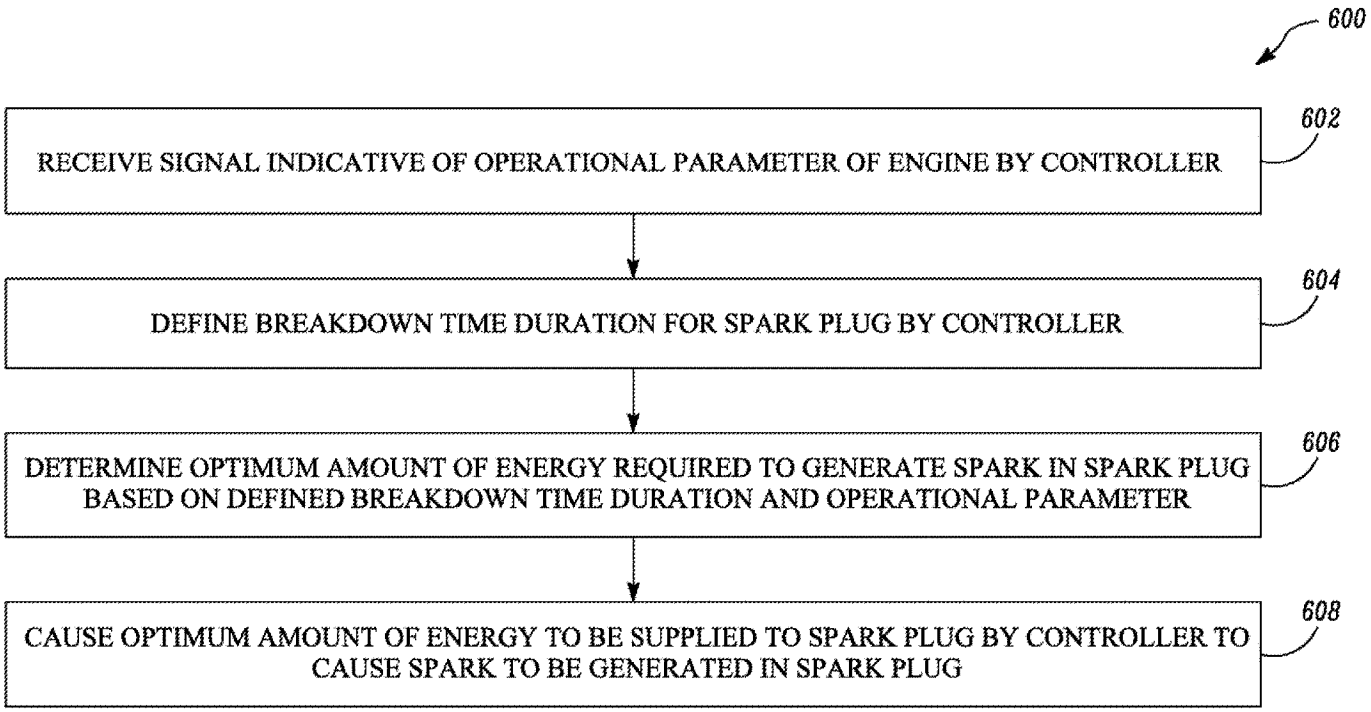
FIG. 6 is a flowchart of a method of controlling a spark plug of an engine, according to some embodiments of the present disclosure.

Referring to FIG. 6, a method 600 of controlling the spark plug 250 of the engine 200 is illustrated. At step 602, the controller 256 receives the signals indicative of an operational parameter of the engine 200. The operational parameter may include engine temperature, engine pressure, humidity, spark plug age, and/or the like. The controller 256 receives the operational parameter from the operational parameter sensor 246.

At step 604, the controller 256 defines the breakdown time duration for the spark plug 250. In some embodiments, the controller 256 may be further configured to determine the post breakdown time duration for the spark plug 250 based on the breakdown time duration. The post breakdown phase may be defined as a time period starting at when breakdown occurs till the time the current in the secondary coil 318 rises. By knowing the breakdown time duration, and the variation of current in secondary coil 318, the controller 256 may determine the post breakdown time duration. By knowing the variation of current in the secondary coil 318, time instance at which the primary current stops to rise can be determined. As the breakdown time duration is known, and the time instance when the primary current stops rising is known, the post breakdown time duration can be determined.

At step 606, the controller 256 determines the optimum amount of energy required to generate the spark for the spark plug 250 based on the defined breakdown time duration and the operational parameter. As evident, the optimum amount of energy shall be sufficient enough to create the ionic channel for the spark plug 250, although it may be set taking into account the operating parameter and the specifications of the spark plug 250 and/or the engine 200. In some embodiments, the controller 256 may be configured to determine the optimum amount of energy required based on the defined breakdown time duration, the operational parameter, the gap between electrodes of the spark plug 250, the engine cylinder pressure, and/or the engine cylinder temperature.

At step 608, the controller 256 causes the optimum amount of energy to be supplied to the spark plug 250 to generate the spark for the spark plug 250. The controller 256 may control the supply of primary current and breakdown voltage in the primary coil 306 so as to cause the optimum amount of energy to be supplied the spark plug 250, as the electrical energy supplied to the primary coil 306 may be defined as a product of the primary current supplied, the voltage i.e. the break down voltage, across the primary coil 306, and the breakdown time period.

The controller 256 may determine the optimum boost voltage corresponding to the optimum amount of energy. Since the optimum amount of energy is fixed, and the primary current is fixed, the controller 256 may then calculate the boost voltage, as the electrical energy supplied to the primary coil 306 may be defined as a product of the primary current supplied, the voltage i.e. the boost voltage, across the primary coil 306, and the breakdown time period. The controller 256 may cause the primary current and the optimum boost voltage to be supplied to the spark plug 250 to cause the supply of the optimum amount of energy required to the spark plug 250.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

No element/component, act/action performed by any element/component, or instruction used herein should be construed as critical or essential unless explicitly described as such. Additionally, the phrase "based on" is intended to mean "based, at least in part, on" unless explicitly stated otherwise. Furthermore, the articles "a" and "an," as used herein, are intended to include one or more items, and may be used interchangeably with "one or more." In the event only one item is intended, the term "one" or similar language is used. Moreover, the terms "has," "have," "having," or the like, as also used herein, are intended to be open-ended terms.

What is claimed is:

1. A controller for an internal combustion engine that includes a spark plug and an ignition coil, the controller configured to:

receive a signal indicative of an operational parameter of the engine;

define a breakdown time duration between a time of energizing the ignition coil and a time of a spark forming at the spark plug;

determine an optimum amount of energy to be supplied to the spark plug for generating a spark, the optimum amount of energy being responsive to the operational parameter;

cause the optimum amount of energy to be supplied to the spark plug; and produce an actual breakdown time duration in the generating of the spark that is based on the defined breakdown time duration, responsive to the supplying of the optimum amount of energy to the spark plug.

2. The controller of claim 1, wherein causing the optimum amount of energy to be supplied comprises:

determining an optimum boost voltage that corresponds to the optimum amount of energy; and causing the optimum boost voltage to be supplied to the spark plug for the spark to be generated.

3. The controller of claim 1, wherein the optimum amount of energy is defined as g minimum possible amount of energy required to generate the spark at per QS the spark plug.

4. The controller of claim 1, wherein the operational parameter of the engine includes one or more of a spark plug age, an engine cylinder pressure, an engine cylinder temperature, or an ambient humidity.

5. The controller of claim 1, wherein the controller is configured to determine the optimum amount of energy required based on the defined breakdown time duration, the operational parameter, and at least one of:

a gap between electrodes of the spark plug, a pressure of a cylinder of the engine, or a temperature of the cylinder of the engine.

6. The controller of claim 1, further being configured to determine the time of the spark forming at the spark plug, wherein determining the time of the spark forming at the spark plug comprises:

detecting a preliminary spark in the spark plug through a spark detection circuit, wherein the preliminary spark is detected prior to the controller receiving the signal indicative of the operational parameter, and determining the breakdown time duration based on detecting of the preliminary spark.

7. The controller of claim 1, wherein the controller is further configured to:

determine a post breakdown time duration for the spark plug based on the breakdown time duration; and determine the optimum amount of energy required to generate the spark at the spark plug based on the determined post breakdown time duration and the operational parameter.

8. A method of controlling an ignition system of an engine, the ignition system including an ignition coil and a spark plug, the method comprising:

receiving, by a controller, a signal indicative of an operational parameter of the engine;

defining, by the controller, a breakdown time duration between a time of energizing the ignition coil and a time of a spark forming at the spark plug;

determining, by the controller, an optimum amount of energy for generating a spark at the spark plug, the optimum amount of energy being responsive to the operational parameter;

causing, by the controller, a primary current and a boost voltage that correspond to the determined optimum amount of energy to be supplied to the ignition coil;

forming a spark by way of the primary current and the boost voltage supplied to the ignition coil; and producing an actual breakdown time duration in the forming of the spark that is based on the defined breakdown time duration, responsive to the supplying of the primary current and the boost voltage that correspond to the determined optimum amount of energy to the ignition coil.

9. The method of claim 8, wherein causing the boost voltage to be supplied to the ignition coil comprises:

determining, by the controller, an optimum boost voltage that corresponds to the optimum amount of energy; and causing, by the controller, the optimum boost voltage to be supplied to the spark plug to generate the spark.

10. The method of claim 8, wherein the optimum amount of energy is defined as a minimum possible amount of energy required to generate the spark at the spark plug.

11. The method of claim 10, wherein the operational parameter of the engine includes one or more of a spark plug age, an engine cylinder pressure, an engine cylinder temperature, or an ambient humidity.

12. The method of claim 8, wherein the controller is configured to determine the optimum amount of energy required based on the defined breakdown time duration, the operational parameter, and at least one of:

a gap between electrodes of the spark plug, a pressure of a cylinder of the engine, and a temperature of the cylinder of the engine.

13. The method of claim 8, further comprising determining the time of the spark forming at the spark plug, wherein determining the time of the spark forming at the spark plug comprises:

detecting, by the controller, a preliminary spark in the spark plug through a spark detection circuit, wherein the preliminary spark is detected prior to receiving the signal indicative of the operational parameter, and determining, by the controller, the breakdown time duration based on detecting of the preliminary spark.

14. The method of claim 8, wherein the controller is further configured to:

determine a post breakdown time duration at the spark plug based at least on the breakdown time duration; and determine the optimum amount of energy required to generate the spark for the spark plug based on the determined post breakdown time duration and the operational parameter.

15. A machine comprising:

an engine having a combustion chamber;

a spark plug configured to ignite a fuel mixture by generating a spark within the combustion chamber;

an operational parameter sensor configured to generate a signal indicative of an operational parameter of the engine;

an ignition coil coupled with the spark plug;

a controller communicably coupled to the engine, the spark plug, the ignition coil, and the operational parameter sensor, the controller configured to:

define a breakdown time duration between a time of energizing the ignition coil and a time of a spark forming at the spark plug;

determine an optimum amount of energy to be supplied to the spark plug, the optimum amount of energy being responsive to the operational;

cause the optimum amount of energy to be supplied to the spark plug;

produce an actual breakdown time duration in the generating of the spark that is based on the defined breakdown time duration, responsive to the supplying of the optimum amount of energy to the spark plug.

16. The machine of claim 15, wherein causing the optimum amount of energy to be supplied comprises:

determining an optimum boost voltage that corresponds to the optimum amount of energy; and causing the optimum boost voltage to be supplied to the spark plug.

17. The machine of claim 15, wherein the operational parameter of the engine includes one or more of a spark plug age, an engine cylinder pressure, an engine cylinder temperature, or an ambient humidity.

18. The machine of claim 15, wherein the controller is configured to determine the optimum amount of energy based on the defined breakdown time duration, the operational parameter, and at least one of:

a gap between electrodes of the spark plug, a pressure of a cylinder of the engine, and a temperature of the cylinder of the engine.

19. The machine of claim 15, wherein defining the breakdown time duration comprises:

detecting a preliminary spark in the spark plug through a spark detection circuit, wherein the preliminary spark is detected prior to the controller receiving the signal indicative of the operational parameter; and determining the breakdown time duration based on the detection of the preliminary spark.

20. The machine of claim 15, wherein the controller is further configured to:

determine a post breakdown time duration for the spark plug based on the breakdown time duration; and determine the optimum amount of energy required to generate the spark at the spark plug based on the determined post breakdown time duration and the operational parameter.

* * * * *